US007917971B2

(12) United States Patent
Kamradt

(10) Patent No.: US 7,917,971 B2
(45) Date of Patent: Apr. 5, 2011

(54) ENERGY ABSORBING AND DISPLACING STRUCTURE FOR ATHLETIC PROTECTIVE EQUIPMENT

(76) Inventor: Brian Edward Kamradt, Indianapolis, IN (US)

( * ) Notice: Subject to any disclaimer, the term of this patent is extended or adjusted under 35 U.S.C. 154(b) by 0 days.

(21) Appl. No.: 12/378,273

(22) Filed: Feb. 13, 2009

(65) Prior Publication Data

US 2010/0205724 A1 Aug. 19, 2010

(51) Int. Cl.
*G21F 3/02* (2006.01)
*G21F 1/12* (2006.01)
*G21F 1/00* (2006.01)

(52) U.S. Cl. ..... 2/455; 2/456; 2/467; 2/2.5; 2/267

(58) Field of Classification Search ..... 2/455, 456, 2/459–467, 2.5, 22–24, 62, 311–322, 267, 2/268, 910, 911
See application file for complete search history.

(56) References Cited

U.S. PATENT DOCUMENTS 3,446,880 A * 5/1969 Enicks ..... 264/46.6
3,585,639 A * 6/1971 Enicks ..... 2/22
4,692,946 A * 9/1987 Jurga ..... 2/22
5,274,846 A * 1/1994 Kolsky ..... 2/460
5,340,352 A * 8/1994 Nakanishi et al. ..... 450/57
5,452,475 A * 9/1995 Hunt, Jr. ..... 2/22
5,491,840 A * 2/1996 Yen ..... 2/461
5,570,470 A * 11/1996 Miller ..... 2/22
5,611,080 A * 3/1997 Skottheim ..... 2/16
5,784,715 A * 7/1998 Buchanan ..... 2/22
6,065,152 A * 5/2000 Parker ..... 2/22
6,305,031 B1 * 10/2001 White ..... 2/455
D571,047 S 6/2008 Kamradt
D593,258 S 5/2009 Kamradt
2005/0108800 A1 * 5/2005 White ..... 2/2.5
2006/0107433 A1 * 5/2006 Olson ..... 2/22
2008/0072359 A1 * 3/2008 Godshaw et al. ..... 2/24
2009/0077702 A1 * 3/2009 Gabry et al. ..... 2/16
2009/0077703 A1 * 3/2009 Gabry et al. ..... 2/16

* cited by examiner

*Primary Examiner* — Bobby H Muromoto, Jr.
(74) *Attorney, Agent, or Firm* — Woodard, Emhardt, Moriarty, McNett & Henry LLP

(57) ABSTRACT

An energy absorbing and displacing structure for athletic protective equipment, such as an athletic shin-guard, is provided using a flexible web-shaped body to hold a rigid band-shaped member in place.
The inner rigid band-shaped member follows the contour of the desired area to protect. The outer flexible web-shaped body is made of a softer rubber like material and works as a locator and supporter keeping the inner, rigid band-shaped member, in proper location.

17 Claims, 4 Drawing Sheets

ENERGY ABSORBING AND DISPLACING STRUCTURE FOR ATHLETIC PROTECTIVE EQUIPMENT

TECHNICAL FIELD

The present invention relates generally to protective equipment for an individual's body, for protecting against blows imparted upon the body during athletic competition.

BACKGROUND OF THE INVENTION

Body protective equipment is commonly worn by participants of contact sports for the purpose of preventing injuries. In these contact sports, various situations may cause injuries. Examples of these situations include tackling or otherwise bumping into other players, falling to the ground, being struck by another player's equipment, or being struck by a game ball itself. Of course, body protective equipment may reduce or prevent injuries resulting from various other circumstances, including those not associated with contact sports.

Existing body protective equipment utilize a relatively significant amount of foam padding for absorbing the energy of blows delivered to the body. Moreover, a rigid hard shell cover typically made of hard plastic, usually overlays the foam padding so as to distribute the force of the blow across a larger area of the foam padding. As is known in the art, distributing the force in this manner permits the foam padding to absorb only a portion of the energy associated with the blow.

A drawback of using a rigid hard shell cover is its limited ability to absorb and displace energy and its lack of flexibility to the user. Another drawback is that the combined use of the foam padding and the rigid hard shell cover adds relatively significant weight to the protective equipment. Since absorbing and displacement of energy is needed to prevent injury and flexible lightweight athletic equipment are known for allowing players freedom of movement, the ridged hard shell cover and its lack of energy absorbing and displacing properties and its lack of flexibility and the added weight are all undesirable results.

Therefore, a need exists for body protective equipment that can absorb and displace the energy from a powerful blow, is flexible, and is relatively lightweight.

Protective equipment also exists to protect other parts of the body from injury during contact athletic events. Such protective equipment includes shin guards, shoulder pads, kneepads, elbow pads, and hip pads. This protective equipment like the athletic shin-guard described above, is typically comprised of foam padding with a plastic cover and thus suffers from the same deficiencies discussed above.

Therefore, a need also exists for protective equipment for any part of the body that can absorb and displace the energy from a powerful blow, is flexible, and is relatively lightweight.

SUMMARY OF THE INVENTION

It is therefore an object of the present invention to provide protective equipment with improved protection for the body of an athlete.

It is another object of the present invention to provide protective equipment that is durable and can withstand a substantial number of blows over a significant period of time.

It is another object of the present invention to provide protective equipment that can absorb and displace the energy from blows.

It is yet another object of the present invention to provide protective equipment that is flexible, lightweight, and allows a user greater freedom of movement and to expend less energy carrying the equipment.

In accordance with the above and other objects of the present invention, a protective athletic shin-guard is provided for protection of blows imparted upon the body of a user. The protective athletic shin-guard includes an inner rigid band-shaped member that follows the curve of the shin bone and provides protection thereto and a outer flexible web-shaped body made of a softer rubber like material and works as a locator and supporter of the rigid band-shaped member, combined the structure works like a spring keeping the inner, rigid band-shaped member, in proper location away from the user allowing for compression.

The combination of these elements allows for the absorption and displacement of the energy of a blow delivered to an individual's body.

One advantage of the present invention is that a user is protected from harmful forces that may injure his shin, knee, and elbow, as well as other parts of the body.

Another advantage of the present invention is that it has a minimized weight for permitting a user to expend more energy participating in an ongoing activity.

Yet another advantage of the present invention is that it is flexible and allows a user greater freedom of movement.

Other advantages of the present invention will become apparent when viewed in light of the detailed description of the preferred embodiment when taken in conjunction with the attached drawings and appended claims.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

This description relates to the general comments herein, as well as the figures referred to above.

Figure 1:
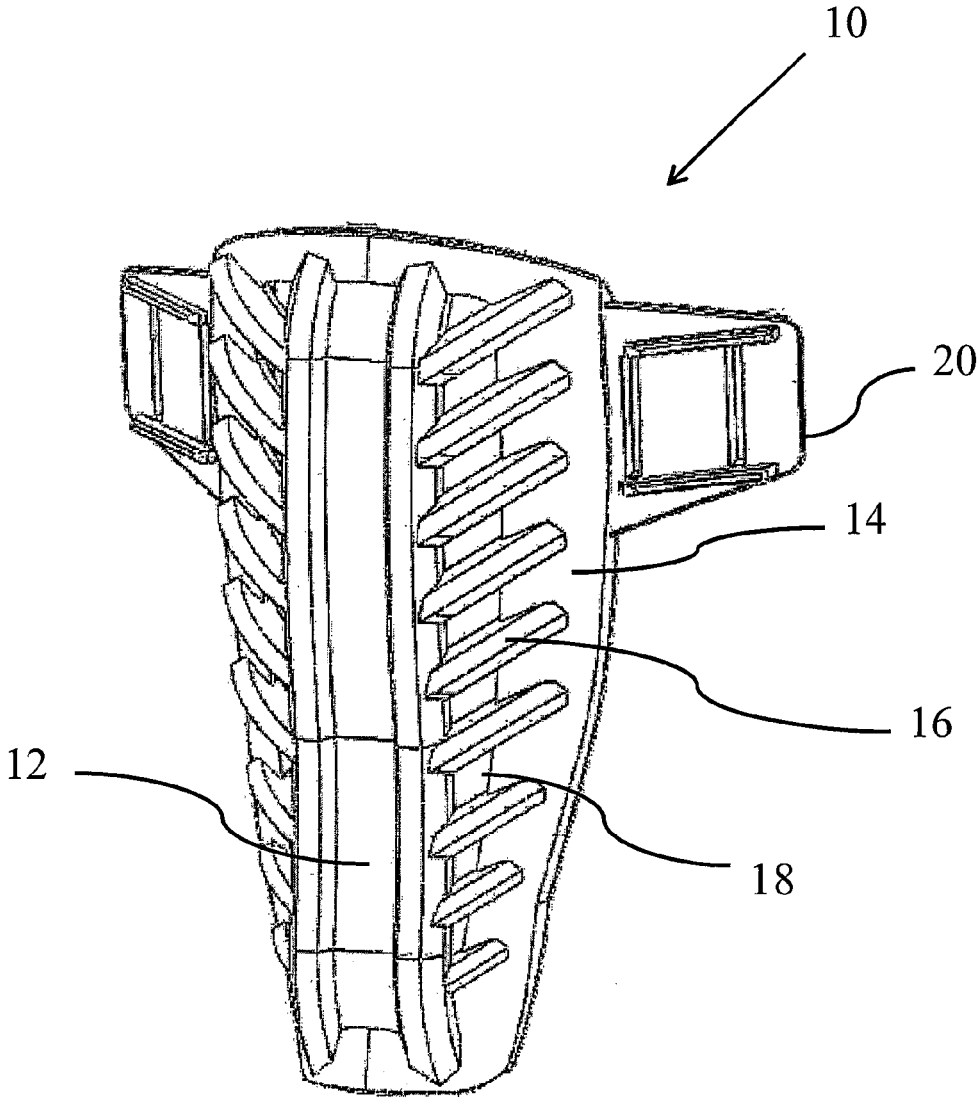
FIG. 1 is a front perspective view of the energy absorbing and displacing structure incorporated in a shin guard.

As noted, FIG. 1 is a front perspective view of the energy absorbing and displacing structure for athletic protective equipment therein. In FIG. 1, the structure is incorporated into an athletic shin-guard 10. As illustrated, guard 10 comprises a middle portion 12 and an outer portion 14 which are connected together by a plurality of ribs 16. Middle portion 12, outer portion 14 and ribs 16 together define a plurality of voids 18. In the depicted embodiment, two securing tabs 20 are positioned near the top of guard 10 and allow a suitable structure to be connected to guard 10 in order for it to be held in place on a user.

Figure 2:
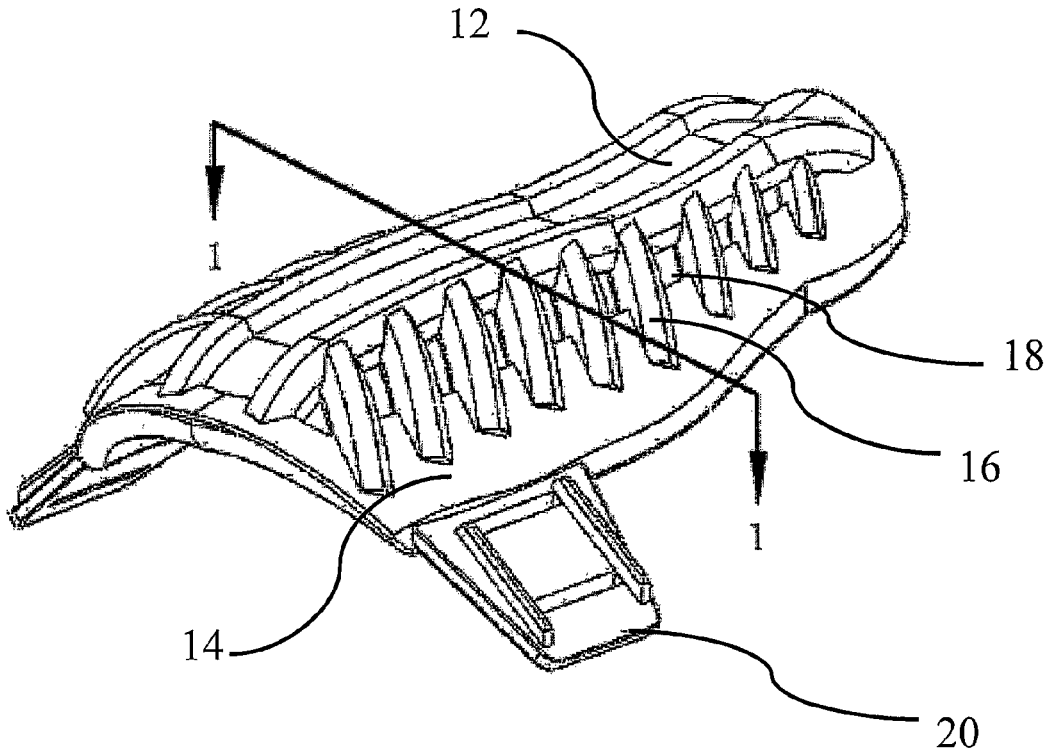
FIG. 2 is another perspective view of the energy absorbing and displacing structure incorporated in a shin guard.

FIG. 2 is yet another perspective view there of.

Figure 3:
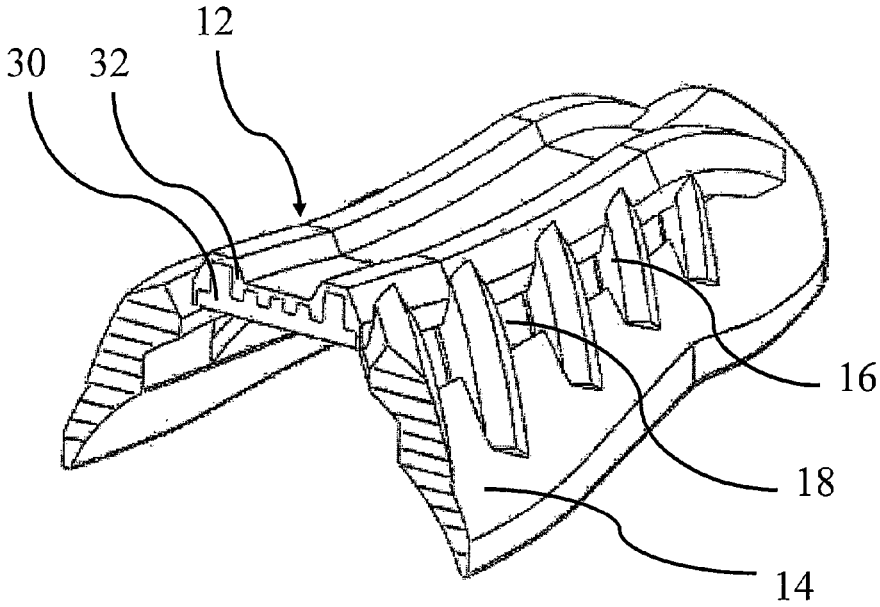
FIG. 3 is a cross-sectional view of the energy absorbing and displacing structure incorporated in a shin guard depicted in FIG. 2

Next, consistent with all of the foregoing, FIG. 3 is a cross-sectional view of the shin guard 10 taken along line 1-1 of FIG. 2, illustrating the impact and energy absorbing structure. In the illustrated embodiment, middle portion 12 comprises of a rigid member 30 and an outer layer 32. In one embodiment, rigid band shaped member 30 is over-molded with the flexible web-shaped body to provide enhanced impact and energy absorption. As depicted, the structure is pre-formed with the rigid band shaped member 30 made of a hard resilient material like polycarbonate, and the flexible web-shaped body, defined by outer portion 14, ribs 16 and the outer layer 32 of middle portion 12, is made of a rubber like material, each is combined in an over mold process to make a complete structure. The webbed like structure is utilized to locate and support the rigid band shaped member 30, also unlike the prior art. As noted, this configuration provides the utmost in impact and energy absorption.

In the preferred mode, a flexible web-shaped body is used to hold a rigid band-shaped member 30 in the desired location.

The inner rigid band-shaped member 30 follows the contour of the desired area to protect. The outer flexible web-shaped body is made of a flexible rubber like material and works as an exoskeleton to hold the inner rigid band-shaped member 30, in the desired location.

Figure 4:
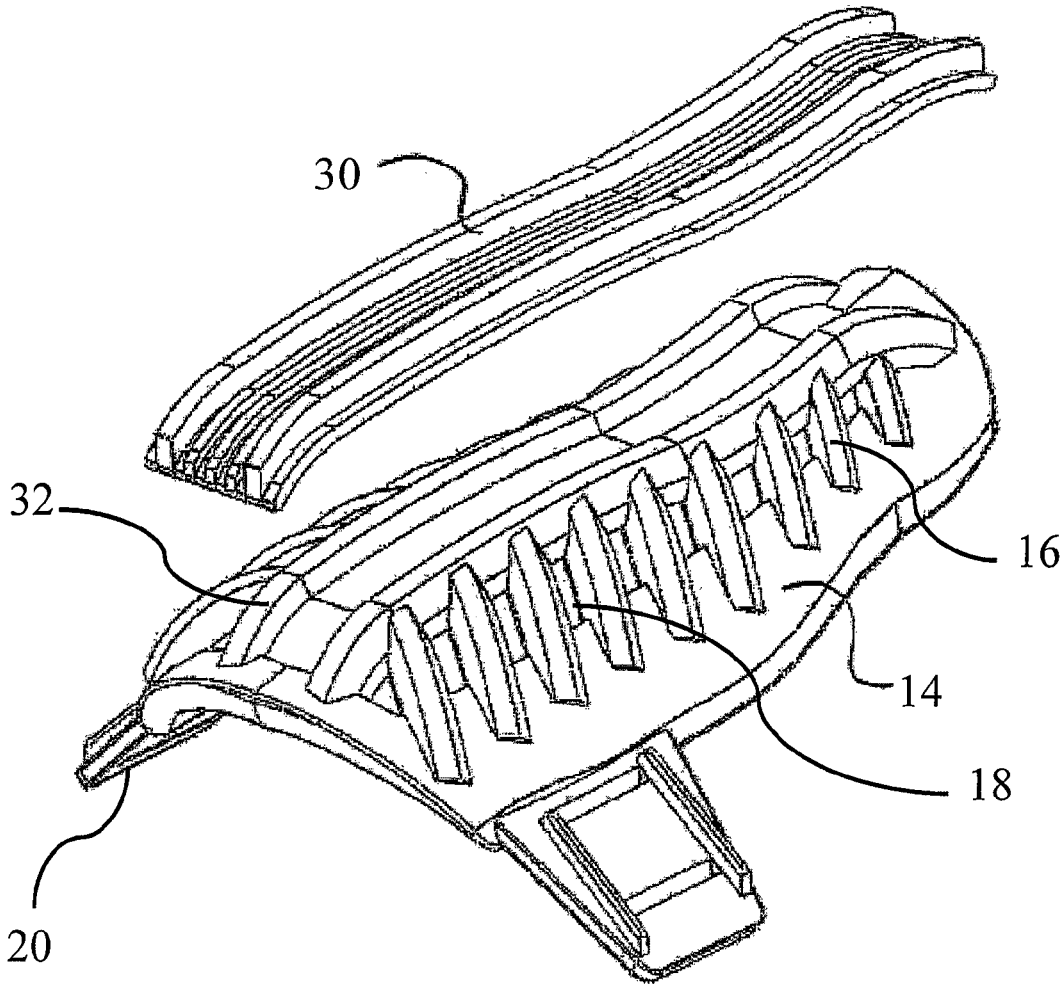
FIG. 4 is a perspective view of the energy absorbing and displacing structure incorporated in a shin guard separated into its components.

In an effort to make the most efficient use possible of the rigid band shaped member 30. In addition, FIG. 4 illustrates that the rigid band shaped member 30 is kept to a minimum and is only as big as the area it is to protect. The length and width will very in size and is dictated by the desired area to protect. For the purposes of example, a flexible web-shaped body defined by outer portion 14, ribs 16 and the outer layer 32 of middle portion 12 together with the rigid band shaped member (2) work like a spring and provide energy absorption and dissipation.

Combined as an assembly it creates a system for great distribution and spreading of forces, thereby reducing the adverse effects of impact in a manner previously unattained.

Importantly, the flexible web-shaped body with its spring like design and rubber like properties working in conjunction inhibits the structure from bottoming out, or reaching their full capacity of energy absorption. Furthermore, the assembly provides for complete memory, which is instantaneous upon release of the force exerted. In addition, the structure functions to allow the outer layer 32 of middle portion 12 of the assembly to receive primary forces, the plurality of ribs 16 of the flexible web-shaped body direct and distribute the forces to the outer portion 14 and the user. As such, the assembly compresses in a unique manner to absorb the force and displace the energy of impact received.

FIG. 4 illustrates the assembly separated into its components. The combined structure allows for the rigid band shaped member 30 and the flexible web-shaped body defined by outer portion 14, ribs 16 and the outer layer 32 of middle portion 12 to work in unison, as opposed to a single rigid structure attempting to absorb all forces received. This simply allows for a far greater amount of energy absorbed by the assembly of the present invention. Thus, regarding the present invention embodied within an athletic shin-guard, the webbed structure will mitigate the incidence of pain and injuries.

The depiction of the invention within an athletic shin-guard is for example purposes only, as the impact and energy absorbing structure may also be utilized on items such as shoulder pads, knee pads, elbow pads, hip pads and other athletic protective equipment.

It should be noted that when two separate devices, each incorporating the assembly of the present invention, collide with one another, the level of energy absorbed and dissipated by the present invention is even greater than the already beneficial result received through usage of just a single such device.

Knee to knee or elbow-to-elbow type collisions are common in many contact sports such as lacrosse, soccer, football and hockey, and usage of the present invention by all players within a game will only reduce the incidence of injury by that much more.

Regarding the present invention and its applications of usage, it is important to distinguish the present invention from prior art structures wherein athletic protective equipment, rather than providing for flexibility and freedom of movement, are rigid, restrictive, and hinder movement. It is the purpose of the present invention to absorb and displace energy for the purpose of injury prevention and user safety while allowing for uninhibited freedom of movement. As such, the present system meets all rules and regulations of all major sports, rendering the same available for any physical activity.

In all such cases, the rigid band shaped member is manufactured in a variety of materials and sizes previously determined to render them effective for multiple previously determined sporting events and hazardous activities. Thus, the assembly may be utilized for protective devices in activities such as diving, swimming, ice hockey, roller hockey, roller skating, skateboarding, field hockey, soccer, lacrosse, football, arena football, gymnastics, baseball, auto racing, motorcycle racing, cycling, and track and field events.

It is imperative to note that the rigid band shaped member of the present invention may be tailored to absorb and dissipate foreseeable forces of humans and objects coming in contact with the assembly. As such, allowing for far greater adaptability to particular needs than traditional pads constructed of hard shell and foam and the like.

It is intended that the rigid band shaped member width also be variable according to particular needs. In all instances, the rigid band shaped member will vary in size in accordance to the area of desired protection, constantly allowing for a secure fit for each application.

Moreover, the impact and energy absorbing structure may be manufactured in a variety of previously determined sizes, functioning to render the assembly effective for multiple previously determined sporting events and hazardous activities. In any such instance, the use of the impact and energy absorbing structure will significantly reduce the quantity of padding and material needed, thus reducing weight to achieve the desired protection.

With regards to all descriptions and graphics, while the present invention has been illustrated and described as embodied, it is not intended to be limited to the details shown herein, since it will be understood that various omissions, modifications, substitutions and changes in the forms and details of the device illustrated, and in its operation, can be made by those skilled in the art without departing in any way from the spirit of the invention.

Without further analysis, the foregoing will so reveal the gist of the present invention that others can readily adapt it for various applications without omitting features that from the standpoint of prior art, constitute characteristics of the generic or specific aspects of this invention. What is claimed as new and desired to be protected by Letters Patent is set forth in the appended claims.

The embodiments of the invention in which an exclusive property or privilege is claimed are defined as follows:

1. An impact and energy absorbing structure comprising:

a middle portion extending along the longitudinal dimension of the energy absorbing structure;

an outer portion constructed and arranged to rest on a body surface, the outer portion is wider than the middle portion;

a plurality of ribs extending from the middle portion and connecting with the outer portion, the plurality of ribs space the middle portion away from the body surface;

a member located within the middle portion, the member is more rigid than the plurality of ribs and the outer portion; and a plurality of voids defined by the middle portion, the outer portion, and the plurality of ribs.

2. The impact and energy absorbing structure of claim 1, wherein the outer portion has a top end and a bottom end, the plurality of ribs extend from the middle portion in an angular direction toward the top end of the outer portion.

3. The impact and energy absorbing structure of claim 1 further comprising a securing tab positioned on the outer portion.

4. The impact and energy absorbing structure of claim 1, wherein the middle portion the has an inner surface and an outer surface, the middle portion is composed of an outer layer defining the outer surface and the member defining the inner surface.

5. The impact and energy absorbing structure of claim 1, wherein the member has a first end and a second end each connected to the outer portion.

6. The impact and energy absorbing structure of claim 1, wherein the member is composed of a polycarbonate material.

7. The impact and energy absorbing structure of claim 1, wherein the outer portion of composed of a flexible material.

8. The impact and energy absorbing structure of claim 7, wherein the outer portion is composed of a rubber-like material.

9. A protective athletic shin guard to protect a shin of a user, the shin guard comprising:

a middle portion extending along the longitudinal dimension of the energy absorbing structure, the middle portion has a first width, the middle portion has an inner surface and an outer surface, the middle portion comprising:

an outer layer defining the outer surface, and a member defining the inner surface, the outer layer and the member are composed of different materials;

an outer portion constructed and arranged to rest on a body surface, the outer portion having a second width;

a plurality of ribs extending from the middle portion and connecting with the outer portion, the plurality of ribs position the middle portion away from the shin;

a member located within the middle portion; and a plurality of voids defined by the middle portion, the outer portion, and the plurality of ribs.

10. The shin guard of claim 9, wherein the second width is larger than the first width.

11. The shin guard of claim 9, wherein the member is more rigid than the plurality of ribs and the outer portion.

12. The shin guard of claim 9, wherein the outer portion has a top end and a bottom end, the plurality of ribs extend from the middle portion in an angular direction toward the top end of the outer portion.

13. The shin guard of claim 9 further comprising a securing tab positioned on the outer portion.

14. The shin guard of claim 9, wherein the member has a first end and a second end each connected to the outer portion.

15. The shin guard of claim 9, wherein the member is composed of a polycarbonate material.

16. The shin guard of claim 9, wherein the outer portion of composed of a flexible material.

17. The shin guard of claim 16, wherein the outer portion is composed of a rubber-like material.

* * * * *